US006673751B1

(12) United States Patent
Cressey et al.

(10) Patent No.: US 6,673,751 B1
(45) Date of Patent: Jan. 6, 2004

(54) BORON CONTAINING OVERBASED CALIXARATES AND LUBRICANTS AND METHODS THEREOF

(75) Inventors: David Cressey, Belper (GB); David J. Moreton, Belper (GB); D. John Durham, Belper (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 10/288,857

(22) Filed: Nov. 6, 2002

(51) Int. Cl.[7] ..... C01M 139/00
(52) U.S. Cl. ..... 508/186; 508/585
(58) Field of Search ..... 508/186, 585

(56) References Cited

U.S. PATENT DOCUMENTS 4,744,920 A 5/1988 Fischer et al.
5,114,601 A 5/1992 Cook et al.
5,205,946 A 4/1993 Cook et al.
5,340,369 A 8/1994 Koch et al.
5,589,445 A * 12/1996 Leahy et al. ..... 508/381
5,635,459 A 6/1997 Stoffa et al.
6,174,844 B1 1/2001 Moreton
6,200,936 B1 * 3/2001 Moreton ..... 508/479
6,268,320 B1 * 7/2001 Crawford ..... 508/572
6,331,510 B1 * 12/2001 Curtis et al. ..... 508/578
6,596,038 B1 * 7/2003 Moreton et al. ..... 44/389

* cited by examiner

*Primary Examiner*—Jacqueline V. Howard
(74) *Attorney, Agent, or Firm*—Michael F. Esposito; Jeffrey F. Munson

(57) ABSTRACT

A composition comprises a sulphur- and phosphorus-free, boron-containing overbased metal salt of a calixarene. The boron-containing overbased calixarene is useful in a lubricant additive composition, a lubricant composition, and a method to lubricate an internal combustion engine. The boron-containing overbased calixarene advantageously provides detergent and antiwear performance and does so without increasing the sulphur or phosphorus content of a lubricant additive or lubricant composition.

18 Claims, No Drawings

BORON CONTAINING OVERBASED CALIXARATES AND LUBRICANTS AND METHODS THEREOF

BACKGROUND OF THE INVENTION

1. Field of the Invention

The present invention involves boron containing metal overbased calixarates that are useful as additives for various applications to include as multifunctional additives in functional fluids and lubricants such as engine oils for internal combustion engines.

2. Description of the Related Art

Functional fluids and lubricants generally contain one or more additives that provide required performance. Engine oil lubricants for internal combustion engines contain additives to provide detergent and antiwear performance. Basic metal salts of arylsulfonates and sulphur-coupled phenates are commonly added to engine oils to provide detergent performance. Optimum antiwear performance in engines is obtained by including a zinc dialkyl dithiophosphate in an engine oil formulation. Contrary to detergent and antiwear performance requirements, current and future engine oils are being required to gradually reduce sulphur and phosphorus content to improve exhaust emissions performance and comply with environmental regulations.

U.S. Pat. No. 5,340,369 discloses diesel fuels that contain organometallic complexes including complexes derived from a calixarene and a metal reactant where the metal can be a mixture of two or more metals that includes boron.

U.S. Pat. Nos. 5,114,601, 5,205,946 and 6174844 disclose overbased metal calixarates useful as additives to lubricating oils.

U.S. Patent No. 4,744,920 discloses borated overbased materials that are useful in lubricating oils.

U.S. Patent No. 5,635,459 discloses a functional fluid having improved gear performance that includes as one of its components an alkali or alkaline earth metal salt complex in the form of borated and/or nonborated salts.

Reviews on calixarenes are found in *Monographs in Supramolecular Chemistry*, by C. David Gutsche, series Editor—J. Fraser Stoddart, published by the Royal Society of Chemistry, 1989 and 1998.

It has now been found that the boron-containing metal overbased calixarates of the present invention are multifunctional additives that provide both detergent and antiwear performance to a functional fluid or lubricant such as an engine oil without increasing the sulphur and phosphorus content since these calixarates are free of sulphur and phosphorus.

SUMMARY OF THE INVENTION

An object of the present invention is to provide detergent and antiwear performance to a lubricant composition.

Another object of the present invention is to provide detergent and antiwear performance to a lubricant composition wherein the lubricant composition is an engine oil for an internal combustion engine.

A further object of the present invention is to provide detergent and antiwear performance to a lubricant composition without increasing the sulphur content and phosphorus content of the lubricant composition.

The objects, advantages and embodiments of the present invention are in part described in this application and in part are obvious from the application or from the practice of this invention. Therefore, it is understood that the invention is claimed as described or obvious as falls within the scope of the appended claims.

To achieve the foregoing objects in accordance with the invention as described and claimed herein, a composition comprises a boron-containing overbased metal salt of a calixarene wherein the calixarene has at least one substituent hydroxyl group capable of reacting with a metal base to form the metal salt; and the boron-containing overbased metal salt of the calixarene is free of sulphur and phosphorus.

In a second embodiment of this invention, a lubricant additive composition comprises the above described composition comprising the boron-containing overbased metal salt of the calixarene wherein the boron-containing overbased calixarate functions as a detergent and an antiwear agent.

In a third embodiment of the present invention, a lubricant composition comprises a lubricating oil and the above described lubricant additive composition.

In a fourth embodiment of this invention, a method to lubricate an internal combustion engine comprises lubricating the engine with the above described lubricant composition that includes the boron-containing overbased calixarate wherein the calixarate provides detergent and antiwear performance without increasing sulphur and phosphorus content.

In a fifth embodiment of this invention, a process to prepare the boron-containing overbased calixarate comprises reacting a calixarene or low based metal salt thereof, a metal base, a solvent as described herein, carbon dioxide, and orthoboric acid or a reactive equivalent thereof that is added before the addition of carbon dioxide.

DETAILED DESCRIPTION OF THE INVENTION

A composition of the present invention comprises a boron-containing overbased metal salt of a calixarene wherein the calixarene has at least one substituent hydroxyl group capable of reacting with a metal base to form the metal salt; and the boron-containing overbased metal salt of the calixarene is free of sulphur and phosphorus.

A metal salt of a calixarene can be termed a metal calixarate, and the boron-containing overbased metal salt of a calixarene can be referred to as a boron-containing overbased calixarate.

The calixarene portion of the boron-containing overbased calixarate is a cyclic oligomer prepared by condensation of a hydroxyl-substituted aromatic hydrocarbon compound with a coupling reagent to form a cyclocondensation product that has a cone or calix-like shape. The hydroxyl-substituted aromatic hydrocarbon compound can have one or more hydroxyl groups to include phenols and resorcinols. The hydroxyl-substituted aromatic hydrocarbon compound can have from zero to three hydrocarbyl substituents. In one embodiment the hydroxy aromatic hydrocarbon compound has no hydrocarbyl substituents and in a second embodiment has one hydrocarbyl substituent. The hydrocarbyl substituent is a univalent radical that contains one or more carbon atoms and is predominately hydrocarbon in nature, but can have heteroatoms in the hydrocarbon chain and can have nonhydrocarbon groups such as a hydroxyl group attached to the hydrocarbon chain. The hydrocarbyl substituent can have on the average 1 to 215 carbon atoms and in other embodiments on average 2 to 100 carbon atoms, 4 to 50 carbon atoms, and 8 to 30 carbon atoms. The hydrocarbyl substituent can be derived from an olefin such as isobutylene, or a mixture of two or more olefins. The hydrocarbyl substituent can be derived from a polyolefin such as a polypropylene tetramer or a $C_{18}$ polyethylene, or a mixture of two or more polyolefins. The polyolefin can be a homopolymer from a single olefin monomer, a copolymer from a mixture of two or more olefin monomers, and includes mixtures of homopolymers and copolymers. The hydrocarbyl substituent can also be derived from a mixture of an olefin and a polyolefin such as a mixture of isobutylene and a polypropylene tetramer. Alternatively to using mixtures of olefins and/or polyolefins, a first hydroxyl aromatic compound can be alkylated with a first olefin or polyolefin, a second hydroxyl aromatic compound can be alkylated with a second olefin or polyolefin, and then the two alkylated hydroxyl aromatic compounds can be admixed. The hydrocarbyl substituent can be a straight chain, a branched chain, or mixtures thereof. Hydrocarbyl-substituted hydroxy-substituted aromatic hydrocarbon compounds can be prepared by well known procedures such as a Lewis acid catalyzed alkylation reaction of phenol with an olefin or polyolefin.

The coupling reagent used to prepare the calixarene can be an aldehyde such as formaldehyde or acetaldehyde, a ketone, a sulfurizing agent such as elemental sulphur, a dihaloalkane, a dihydroxyalkane, or mixtures thereof.

The number of repeating units of the hydroxy-substituted aromatic hydrocarbon compound in the calixarene can be at least 3 and in other embodiments of the invention can be at least 4, or 3 to 12, or 4 to 12. In another embodiment of the present invention the calixarene can be a mixture of cylic oligomers having different numbers of repeating units of the hydroxy-substituted aromatic hydrocarbon compound such as a mixture of 4 and 6 repeating units or a mixture of 6 and 8 repeating units termed respectively a calix[4,6]arene and a calix[6,8]arene.

In an embodiment of the present invention the calixarene portion of the boron-containing overbased metal salt of the calixarene can be represented by the formula

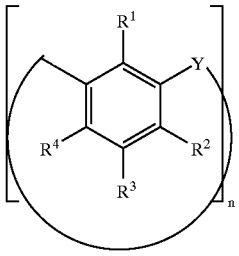

where Y is a divalent group; either $R^1$ is hydroxyl and $R^2$ and $R^4$ are independently hydrogen or hydrocarbyl or $R^1$ is hydrogen or hydrocarbyl and $R^2$ and $R^4$ are hydroxyl; $R^3$ is hydrogen or hydrocarbyl; and n is 3 to 12. The divalent group Y is derived from the coupling agent used to form the calixarene and can be hydrocarbylene, a sulphide or polysulphide, or mixtures thereof. The hydrocarbylene group is defined the same as hereinabove for the hydrocarbyl substituent except that the hydrocarbylene group is a divalent radical of one or more carbon atoms, usually 1 to 10 carbon atoms. In another instance Y is a methylene, $R^1$ is hydroxyl, $R^2$ and $R^4$ are hydrogen, and $R^3$ is an alkyl group having an average of 4 to 50 carbon atoms.

In a further embodiment of this invention the calixarene is prepared from a hydrocarbyl-substituted phenol and an aldehyde. In a further instance of the invention the hydrocarbyl-substituted phenol is on average a $C_{10}$–$C_{24}$ alkylphenol, the aldehyde is formaldehyde or a reactive equivalent thereof, and the number of repeating phenolic units in the calixarene is 4 to 12.

Calixarenes of the present invention can be prepared by reacting a hydroxy-substituted aromatic hydrocarbon compound such as an alkylphenol with a coupling reagent such as an aldehyde in the presence of a base by the method described in *Monographs in Supramolecular Chemistry* by C. David Gutsche, Series Editor—J. Fraser Stoddart, published by Royal Society of Chemistry, 1989 and 1998.

The metal of the metal salt or of the overbased metal salt of the calixarene can be any metal or reactive equivalent thereof that is capable of forming a salt with the calixarene. Thus, metals of the present invention include both elemental metals as well as metal compounds that can form a salt with the calixarene. In an embodiment of the present invention the metal is a univalent metal, a divalent metal, or a mixture thereof. In another embodiment of the invention the metal is an alkali metal, an alkaline earth metal such as calcium, or a mixture thereof such as calcium with lithium, sodium, or potassium.

The overbased metal salt of the calixarene will contain an excess of equivalents of basic metal relative to acid equivalents from the calixarene and any co-substrates as described herein below such as a carboxylic acid. Typically the overbased calixarate will contain greater than 1.2 equivalents of basic metal per equivalent of acid, and can contain 4.5 or greater equivalents of basic metal per equivalent of acid.

The boron-containing overbased metal salt of the calixarene can be prepared by reacting the overbased calixarate with orthoboric acid or a reactive equivalent thereof. In another embodiment of the invention the boron-containing overbased calixarate is prepared by adding orthoboric acid or a reactive equivalent thereof to the calixarene and then overbasing this admixture. The boron content of the boron-containing overbased metal salt of the calixarene can be 0.05 to 5% by weight, and in other embodiments of the invention can be 0.06 to 2.5% by weight and also 0.07 to 2% by weight.

A lubricant additive composition of the present invention comprises the boron-containing overbased metal salt of the calixarene that functions as a detergent and an antiwear agent. The boron-containing overbased calixarate functions as a detergent in part due to its basicity reserve and in part due to its bipolar hydrophilic, lipophilic composition. The boron-containing overbased calixarate also functions as an antiwear agent, as demonstrated in the examples hereinbelow, partly due to the overbased calixarate and partly due to the further presence of a borate component in the overbased calixarate. The lubricant additive composition can further comprise a lubricating oil as described hereinbelow. The lubricating oil can serve as an inert reaction solvent during preparation of the boron-containing overbased calixarate and later as a dilutent to facilitate handling and transfer of the lubricant additive composition. The lubricating oil in the lubricant additive composition can range from 0 to 90% by weight, but more commonly ranges from 5 to 60% by weight.

A lubricant composition of the present invention comprises a lubricating oil and the lubricant additive composition that comprises the composition comprising the boron-containing overbased metal salt of the calixarene as described throughout this application. The lubricant composition can be used in any application that benefits from a lubricant additive composition that functions as a detergent and an antiwear agent. Applications where the lubricant composition can be used include engine oils for all types of internal combustion engines, gear oils, metalworking fluids, transmission fluids, hydraulic fluids, and greases. The lubricant composition can be used in any application that benefits from a lubricant additive composition that functions as a detergent and antiwear agent without increasing the sulphur content and/or the phosphorus content of the lubricant composition. The lubricant composition of the present invention is especially useful in engine oils for internal combustion engines where there is a requirement to reduce the sulphur and phosphorus content to improve engine exhaust emissions to meet environmental standards.

The amount of the boron-containing overbased metal salt of the calixarene in the lubricant composition will be an amount that provides detergent and antiwear performance. The content of the boron-containing overbased calixarate in the lubricant composition can be 0.1 to 50% by weight, and in other embodiments can be 0.2 to 20% by weight, 0.3 and 10% by weight, and 0.5 to 7% by weight.

The lubricating oil of the lubricant composition can be any oil or combination of oils, to include natural and synthetic oils, that functions as a lubricating oil in the lubricant composition. The lubricating oil can be various types of unrefined and refined mineral oils to include oils in the American Petroleum Institute Base Oil Groups I, II, III and V, polyolefins to include poly(alpha-olefins) and olefin copolymers, esters of carboxylic acids such as diisodecyl azelate, alkylated aromatic hydrocarbons such as dodecylbenzene, animal oils, vegetable oils, polymers of alkylene oxides and ester and ether derivatives thereof, silicon-based oils to include various silicones, and esters of phosphorus based acids such as phosphoric and phosphonic acids. The lubricating oil is generally present in the lubricant composition in a major amount of 50% or more by weight, and in other embodiments of the invention can be present at 75% or more by weight, or at 95% or more by weight.

The lubricant composition can also contain one or more additional lubricant additives depending on the application that the lubricant composition is intended to be used for. The lubricant composition can further comprise at least one lubricant additive composition selected from the group consisting of a detergent, a dispersant, an antiwear agent, an antioxidant, a corrosion inhibitor, a friction modifier, a foam control agent, and a viscosity modifier to include viscosity index improvers and pour point depressants.

In another embodiment of this invention the lubricant composition is an engine oil for an internal combustion engine. In further embodiments of the invention the engine oil has a sulphur content below 0.5% by weight, below 0.3% by weight, or below 0.2% by weight. In still further embodiments of this invention the engine oil has a phosphorus content below 0.1% by weight, below 0.07% by weight, or below 0.05% by weight.

A method of the present invention to lubricate a device or system comprises lubricating the device or system with the lubricant composition that contains the boron-containing overbased calixarate which provides detergent and antiwear performance without increasing the sulphur content and the phosphorus content of the lubricant composition. In another embodiment of the invention a method to lubricate an internal combustion engine comprises lubricating the engine with the lubricant composition that contains the boron-containing overbased metal salt of the calixarene that provides detergent and antiwear performance without increasing the sulphur content and phosphorus content of the lubricant composition.

A process of the present invention to prepare the boron-containing overbased metal salt of the calixarene comprises reacting at an elevated temperature the calixarene or a low based metal salt thereof; a metal base that is added in one or more than one addition during the reaction; a solvent comprising (a) a polyhydric alcohol or a poly-(alkylene glycol) optionally in combination with a hydrocarbon solvent, a mineral oil, water, a monohydric alcohol, a carboxylic acid ester, a ketone, or an ether, or (b) a monohydric alcohol in combination with a hydrocarbon solvent or a mineral oil; carbon dioxide that is added in one or more than one addition after the addition of the metal base; and orthoboric acid or a reactive equivalent thereof that is added before the addition of carbon dioxide.

The process of preparing the boron-containing overbased calixarate can use as a reactant the calixarene, a low based metal salt of the calixarene, or a lesser overbased metal salt of the calixarene. A low based metal salt of the calixarene will generally contain from less than 1 to 1.2 equivalents of basic metal per equivalent of acid from the calixarene and any acidic co-substrates. In other embodiments of the present invention the equivalents of basic metal per equivalent of acid in the low based calixarate can range from 0.1 to 1.2, from 0.5 to 1.2, and from 0.8 to 1.2.

The metal base used to prepare the boron-containing overbased calixarate can be any metal base or reactive equivalent thereof that can form a metal salt with the calixarene to include elemental metals and metal compounds. Especially useful as metal bases are alkali and alkaline earth metal compounds to include alkali metal hydroxides, alkaline earth metal oxides, and alkaline earth metal hydroxides such as sodium hydroxide, magnesium oxide and calcium hydroxide.

The solvent used in the reaction to prepare the boron-containing overbased calixarate can comprise a polyhydric alcohol or poly(alkylene glycol) such as ethylene glycol, diethylene glycol, or the methyl ether of diethylene glycol optionally in combination with a hydrocarbon solvent such as toluene or xylene, a mineral oil, water, a $C_1$–$C_{20}$ monohydric alcohol, a carboxylic acid ester such as ethyl acetate, or an ether. Alternatively the solvent can comprise a $C_1$–$C_4$ monohydric alcohol such as methanol in combination with a hydrocarbon solvent or a mineral oil. U.S. Pat. No. 5205946 describes in detail a solvent that can be used to prepare the boron-containing overbased calixarate. The solvent is generally added to the reaction mixture prior to starting the reaction, but can also be added throughout the reaction to facilitate processing.

Orthoboric acid $H_3BO_3$ or a reactive equivalent thereof can be used to prepare the boron-containing overbased metal salt of the calixarene. Reactive equivalents of orthoboric acid include organo borate esters such as the trialkyl borate ester tri(2-ethylhexyl) borate, boric acid anhydrides such as a metaboric acid $HBO_2$ and boron oxide $B_2O_3$, and metal borate salts such as borax $Na_2B_4O_7.10H_2O$.

The process of preparing boron-containing overbased calixarates, in which orthoboric acid or a reactive equivalent thereof is added before the addition of carbon dioxide and before the start of the preparatory reaction, is detailed in the examples herein-below. In another embodiment of the invention, boron-containing overbased calixarates are prepared by adding orthoboric acid or a reactive equivalent thereof after the addition of carbon dioxide and after the calixarene is overbased. U.S. Pat. Nos. 5205946 and 4744920 respectively detail a procedure for preparing an overbased metal salt of a calixarene and a procedure for preparing a boron-containing overbased material by reacting an overbased material with a borating agent such as orthoboric acid.

The boron-containing overbased metal salt of the calixarene of the present invention can contain at least one co-substrate selected from the group consisting of a $C_6$–$C_{100}$ carboxylic acid or anhydride thereof such as tall oil fatty acids, a $C_{12}$–$C_{100}$ polycarboxylic acid or anhydride thereof such as octadecenylsuccinic anhydride, a hydrocarbyl-substituted phenol such as a dodecylphenol, a hydrocarbyl-substituted sulphonic acid, a hydrocarbyl-substituted salicylic acid, and a hydrocarbyl-substituted naphthenic acid. The co-substrates can be added any time during the preparation of the boron-containing overbased calixarate, but are normally added before the start of the preparatory reaction.

The lubricant additive composition and lubricant composition of the present invention are generally prepared by blending or mixing the components at ambient temperature to elevated temperatures of 40 to 100° C. until the resultant composition is homogeneous.

EXAMPLES

The following examples are instances of the invention for illustrative purposes, but are not intended to limit the scope of the invention.

Example A (comparative) is a refined 100 Neutral mineral oil.

Example B is an overbased calixarate having 331 TBN and prepared by the following procedure.

To a reactor, fitted for distillation, was charged a 50% solution of a calixarene, prepared from a mixture of 80 wt. % dodecylphenol from polypropylene tetramer and 20 wt. % 2,6-di-t-butylphenol, in 150 S Neutral mineral oil (283g, 0.54 moles), tall oil fatty acids (130g, 0.46 moles), ethylene glycol (13g), 2-ethyl-1-hexanol (103g), calcium hydroxide (142g, 1.92 moles), and p-dodecylphenol (33g, 0.12 moles). The charged materials were mixed with a stirrer and heated to 105° C. under a reduced pressure of 0.63 atmosphere (481 mm Hg). After reaching 105° C., the pressure was further reduced to 0.04 atmosphere (29 mm Hg), and the mixture of charged materials was held there for 40 minutes. The pressure was then raised to 0.63 atmosphere (481 mm Hg), the temperature was increased to 130° C., and additional ethylene glycol (35g) was added dropwise over 5 minutes to the reaction mixture. The reaction mixture was then carbonated for 80 minutes at a rate of about 1g of carbon dioxide per minute. The reaction mixture was then heated to 210° C. at a reduced pressure of 0.06 atmosphere (49 mm Hg) to remove all solvents. The crude product was filtered hot through a sintered funnel layered with diatomaceous earth to give a clear brown liquid product having a TBN (total base number) of 331 (mg equivalents of KOH per g of sample), 12.5% by wt. Ca, 23.2% by wt. calixarene content, and a kinematic viscosity of 99.4 cSt at 100° C.

Example C is a boron-containing overbased calixarate having 202 TBN and 1.5% B and prepared by the following procedure.

To a reactor, fitted for distillation, was charged a 50% solution of a calixarene, prepared from a mixture of 80 wt.% dodecylphenol from polypropylene tetramer and 20 wt. % 2,6-di-t-butylphenol, in 150 S Neutral mineral oil (286g, 0.55 moles), tall oil fatty acids (132g, 0.46 moles), ethylene glycol (14g), 2-ethyl-1-hexanol (105g), calcium hydroxide (144g, 1.95 moles), orthoboric acid (116g, 1.88 moles), and p-dodecylphenol (33g, 0.12 moles). The charged materials were mixed with a stirrer and heated to 105° C. under a reduced pressure of 0.63 atmosphere (481 mm Hg). After reaching 105°C., the pressure was further reduced to 0.04 atmosphere (29 mm Hg), and the mixture of charged materials was held there for 40 minutes. The pressure was then raised to 0.63 atmosphere (481 mm Hg), the temperature was increased to 130° C., and additional ethylene glycol (37g) was added dropwise over 5 minutes to the reaction mixture. The reaction mixture was then carbonated for 80 minutes at a rate of about 1g carbon dioxide per minute. The reaction mixture was then heated to 210° C. at a reduced pressure of 0.06 atmosphere (49 mm Hg) to remove all solvents. The crude product was filtered hot through a sintered funnel layered with diatomaceous earth to give a clear brown liquid product having a TBN of 202, 7.1% by wt. Ca, 1.5% by wt. B, a 22.2% by wt. calixarene content, and a kinematic viscosity of 237.5 cSt at 100° C.

Example D is a boron-containing overbased calixarate having 274 TBN, 10.3% by wt.Ca, 0.46% by wt. B, a 23% by wt. calixarene content, and a kinematic viscosity of 549.3 cSt at 100° C. and prepared by the procedure of Example C except that the amount of the orthoboric acid is decreased by 82.5%.

Example E is a boron-containing overbased calixarate having 240 TBN and 0.4% B and prepared by the following procedure.

To a reactor, fitted for distillation, was charged a 50% solution of a calixarene, prepared from a mixture of 80 wt. % dodecylphenol from polypropylene tetramer and 20 wt. % 2,6-di-t-butylphenol, in 150 S Neutral mineral oil (197g, 0.38 moles), tall oil fatty acids (91g, 0.32 moles), ethylene glycol (16g), 2-ethyl-1-hexanol (117g), calcium hydroxide (72g, 0.9 moles), orthoboric acid (13g, 0.21 moles), and p-dodecylphenol (32g, 0.12 moles). The charged materials were mixed with a stirrer and heated to 105° C. under a reduced pressure of 0.63 atmosphere (481 mm Hg). After reaching 105° C., the pressure was further reduced to 0.04 atmosphere (29 mm Hg), and the mixture of charged materials was held there for 40 minutes. The pressure was then raised to 0.63 atmosphere (481 mm Hg), the temperature was increased to 130° C., and additional ethylene glycol (36g) was added dropwise over 5 minutes to the reaction mixture. The reaction mixture was then carbonated for 40 minutes at a rate of about 1g carbon dioxide per minute. The reaction mixture was then heated to 210° C. at a reduced pressure of 0.06 atmosphere (49 mm Hg) to remove all solvents. The crude product was filtered hot through a sintered funnel layered with diatomaceous earth to give a clear brown liquid product having a TBN of 240, 8.8% by wt. Ca, 0.4% by wt. B, a 23.4% by wt. calixarene content, and a kinematic viscosity of 405 cSt at 100°C.

Example F is an overbased calixarate having 254 TBN, 9.2% by wt. Ca, a 24.7% by wt. calixarene content, and a kinematic viscosity of 49.5 cSt at 100° C. and prepared by the procedure of Example E except that orthoboric acid is omitted.

Example G is an overbased calixarate having 157 TBN and prepared by the following procedure.

To a reactor, fitted for distillation, was charged a 50% solution of a calixarene, prepared from a mixture of 80 wt. % dodecylphenol from polypropylene tetramer and 20 wt. % 2,6-di-t-butylphenol, in 150 S Neutral mineral oil (205g, 0.4 moles), tall oil fatty acids (95g, 0.34 moles), ethylene glycol (16g), 2-ethyl-1-hexanol (125g), calcium hydroxide (64.5g, 0.87 moles), and p-dodecylphenol (49g, 0.19 moles). The charged materials were mixed with a stirrer and heated to 105° C. under a reduced pressure of 0.63 atmosphere (481 mm Hg). After reaching 105° C., the pressure was further reduced to 0.04 atmosphere (29 mmHg), and the mixture of charged materials was held there for 40 minutes. The pressure was then raised to 0.63 atmosphere (481 mm Hg), the temperature was increased to 130° C., and additional ethylene glycol (56g) was added dropwise over 5 minutes to the reaction mixture. The reaction mixture was then carbonated for 31.5 minutes at a rate of about 0.5g carbon dioxide per minute. The reaction mixture was then heated to 210° C. at a reduced pressure of 0.06 atmosphere (49 mm Hg) to remove all solvents. The crude product was filtered hot through a sintered funnel layered with diatomaceous earth to give a clear brown liquid product having a TBN of 157, 5.5% by wt. Ca, a 16.9% by wt. calixarene content, and a kinematic viscosity of 17 cSt at 100°C.

Example H is a boron-containing overbased calixarate having 142 TBN, 5% by wt. Ca, 0.47% by wt. B, a 15.1% by wt. calixarene content, and a kinematic viscosity of 71.7 cSt at 100° C. and prepared by the procedure of Example G except that orthoboric acid (19g, 0.306 moles) is also initially charged to the reactor.

Study 1—Calixarates in Mineral Oil in Programed Temperature HFRR

The 100 Neutral mineral oil of Example A and samples of 100 Neutral mineral oil containing the calixarates of Examples B-H at 2.5 and 5 wt. % treatment levels were evaluated for wear performance in a programmed temperature high frequency reciprocating rig (HFRR) available from PCS Instruments. HFRR conditions for the evaluations were 200g load, 75 minute duration, 1000 micrometer stroke, 20 hertz frequency, and temperature profile of 15 minutes at 40° C. followed by an increase in temperature to 160° C. at a rate of 2° C. per minute. Wear scar in micrometers and film formation as percent film thickness were then measured with lower wear scar values and higher film formation values indicating improved wear performance. The data in the following table indicate that the boron-containing overbased calixarates provide improved wear performance compared to untreated mineral oil or mineral oil treated with an overbased calixarate and that boron-containing overbased calixarates with a lower level of boron provide optimum wear performance.

| | 2.5 wt. % Treatment | | 5 wt. % Treatment | |
|---|---|---|---|---|
| Example | Wear Scar | Film | Wear Scar | Film |
| A(Mineral Oil) | 311 | 0 | — | — |
| B(331TBN) | 225 | 31 | 198 | 47 |
| C(202TBN, 1.5%B) | 191 | 95 | 203 | 99 |
| D(274TBN, 0.46%B) | 162 | 100 | 164 | 98 |
| E(240TBN, 0.4%B) | 202 | 67 | 158 | 99 |
| F(254TBN) | 219 | 18 | 203 | 39 |
| G(157TBN) | 214 | 6 | 200 | 25 |
| H(142TBN, 0.47%B) | 153 | 96 | 136 | 100 |

Examples I-N are fully formulated engine oils for an internal combustion engine prepared from American Petroleum Institute Group III base oils as detailed in the following table with all values as wt. percents.

Comparative Example I is a conventional engine oil containing a standard level (0.9%) of a zinc dialkyl dithiophosphate (ZDDP) anti wear agent.

Comparative Example J is a low sulphur, low phosphorus engine oil containing half of the standard level (0.45%) of the ZDDP antiwear agent.

Examples K-N are also low sulphur, low phosphorus engine oils a) containing half of the standard level (0.45%) of the ZDDP, b) containing respectively the calixarates of Examples B, D, G and H as replacements for the standard phenate detergent, and c) having a portion of the sulphonate detergent removed in Examples K and L to deliver the same TBN level as the conventional oil of Example I.

| Additive | I | J | K | L | M | N |
|---|---|---|---|---|---|---|
| Base Oil | 80.30 | 80.75 | 80.75 | 80.75 | 79.75 | 79.75 |
| Dispersant | 6.1 | 6.1 | 6.1 | 6.1 | 6.1 | 6.1 |
| Mixture of amine and phenolic antioxidants | 1.0 | 1.0 | 1.0 | 1.0 | 1.0 | 1.0 |
| Pour Point Depressant | 0.2 | 0.2 | 0.2 | 0.2 | 0.2 | 0.2 |
| Viscosity Modifier | 1.0 | 1.0 | 1.0 | 1.0 | 1.0 | 1.0 |
| Lubricity modifier | 0.1 | 0.1 | 0.1 | 0.1 | 0.1 | 0.1 |
| Antifoam | 0.01 | 0.01 | 0.01 | 0.01 | 0.01 | 0.01 |
| Additional Diluent Oil | 7.39 | 7.39 | 7.39 | 7.39 | 7.39 | 7.39 |
| ZDDP antiwear | 0.9 | 0.45 | 0.45 | 0.45 | 0.45 | 0.45 |
| Sulphonate detergent | 1.8 | 1.8 | 0.8 | 0.8 | 1.8 | 1.8 |
| Phenate Detergent | 1.2 | 1.2 | | | | |
| Example B | | | 2.2 | | | |
| Example D | | | | 2.2 | | |
| Example G | | | | | 2.2 | |
| Example H | | | | | | 2.2 |

Sulphur, phosphorus and boron elemental analyses for the engine oils of Examples I-N are given in the following table.

| Example | Sulphur | Phosphorus | Boron |
|---|---|---|---|
| I | 0.28 | 0.097 | 0 |
| J | 0.19 | 0.048 | 0 |
| K | 0.12 | 0.047 | 0 |
| L | 0.12 | 0.047 | 0.0097 |
| M | 0.15 | 0.046 | 0 |
| N | 0.12 | 0.047 | 0.0097 |

Study 2—Calixarates in Engine Oils in Programed Temperature HFRR

The engine oil Examples I-N were evaluated for wear performance as new oils in a programmed temperature high frequency reciprocating rig using the same conditions as described hereinabove for Study 1. Examples I-N were also treated at 0.1 volume % with the oxidizing agent cumene hydroperoxide, which decreases the wear performance provided by the ZDDP, and then evaluated as "old oils" in the HFRR under the same conditions used for the new oils. The data in the following table indicate for new oils that the low phosphorus, low sulphur oils of Examples K-N, containing a calixarate whether it is overbased or boron-containing overbased, are improved on wear performance in terms of wear scar compared to a full phosphorus, full sulphur oil of Example I or a low phosphorus, low sulphur oil of Example J. The data for old oils indicate that the low phosphorus, low sulphur oils containing a boron-containing overbased calixarate of Examples L and N are improved on wear performance in terms of wear scar and film formation compared to low phosphorus, low sulphur oils of Examples J, K and M that do or do not contain an overbased calixarate. Additonally, the low P, low S oils containing a boron-containing overbased calixarate of Examples L and N are equivalent to or better than a full P, full S oil of Example I on wear performance.

| Example | New Oil | | Old Oil | |
|---|---|---|---|---|
| | Wear Scar | Film | Wear Scar | Film |
| I(0.1P) | 178 | 82 | 230 | 56 |
| J(0.05P) | 172 | 94 | 263 | 13 |
| K(0.05P) | 116 | 99 | 288 | 17 |
| L(0.05P, 0.01B) | 153 | 99 | 201 | 56 |
| M(0.05P) | 154 | 98 | 278 | 7 |
| N(0.05P, 0.01B) | 151 | 91 | 229 | 49 |

Each of the documents cited in this Detailed Description of the Invention is incorporated herein by reference. With the exception of the Examples, all numerical quantities used throughout this application to describe or claim the invention are understood to be modified by the word "about". Unless indicated otherwise, quantities used for chemical compositions throughout this application are understood to be on an active chemical basis and not to include any diluent that may be present in these compositions.

What is claimed is:

1. A composition, comprising:

a boron-containing overbased metal salt of a calixarene wherein the calixarene has at least one substituent hydroxyl group capable of reacting with a metal base to form the metal salt; and the boron-containing overbased metal salt of the calixarene is free of sulphur and phosphorus.

2. The composition of claim 1 wherein the calixarene is represented by the formula

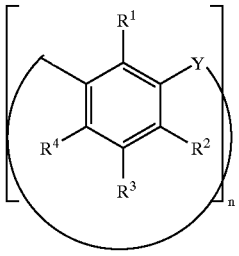

wherein Y is a hydrocarbylene group; either $R^1$ is hydroxyl and $R^2$ and $R^4$ are independently hydrogen or hydrocarbyl or $R^1$ is hydrogen or hydrocarbyl and $R^2$ and $R^4$ are hydroxyl; $R^3$ is hydrogen or hydrocarbyl; and n is 3 to 12.

3. The composition of claim 1 wherein the calixarene is prepared from a hydrocarbyl-substituted phenol and an aldehyde.

4. The composition of claim 2 wherein Y is methylene; Rhu 1is hydroxyl; $R^2$ and $R^4$ are hydrogen; and $R^3$ is an alkyl group having an average of 4 to 50 carbon atoms.

5. The composition of claim 4 wherein the metal of the metal salt is a monovalent metal, a divalent metal, or a mixture thereof.

6. The composition of claim 5 wherein the metal of the metal salt is an alkali metal, an alkaline earth metal, or a mixture thereof.

7. A lubricant additive composition, comprising:

the composition of claim 1 wherein the boron-containing overbased metal salt of the calixarene functions as a detergent and an antiwear agent.

8. A lubricant composition, comprising:

a lubricating oil; and the lubricant additive composition of claim 7.

9. The lubricant composition of claim 8 wherein the content of the boron-containing overbased metal salt of the calixarene is 0.1 to 50% by weight.

10. The lubricant composition of claim 8 wherein the boron content of the boron-containing overbased metal salt of the calixarene is 0.05 to 5% by weight.

11. The lubricant composition of claim 8, further comprising:

at least one lubricant additive composition selected from the group consisting of a detergent, a dispersant, an antiwear agent, an antioxidant, a corrosion inhibitor, a friction modifier, a foam control agent, and a viscosity modifier.

12. The lubricant composition of claim 8 wherein the lubricant composition is an engine oil for an internal combustion engine.

13. The lubricant composition of claim 12 wherein the engine oil has a sulphur content below 0.2% by weight.

14. The lubricant composition of claim 12 wherein the engine oil has a phosphorus content below 0.07% by weight.

15. A method to lubricate an internal combustion engine, comprising:

lubricating the engine with the lubricant composition of claim 12 wherein the boron-containing overbased metal salt of the calixarene provides detergent and antiwear performance without increasing the sulphur content and the phosphorus content of the lubricant composition.

16. A process to prepare the boron-containing overbased metal salt of the calixarene of claim 1, comprising:

reacting at an elevated temperature the calixarene or a low based metal salt thereof;

a metal base that is added in one or more than one addition during the reaction;

a solvent comprising (a) a polyhydric alcohol or a poly (alkylene glycol) optionally in combination with a hydrocarbon solvent, a mineral oil, water, a monohydric alcohol, a carboxylic acid ester, a ketone, or an ether, or (b) a monohydric alcohol in combination with a hydrocarbon solvent or a mineral oil;

carbon dioxide that is added in one or more than one addition after the addition of the metal base; and orthoboric acid or a reactive equivalent thereof that is added before the addition of carbon dioxide.

17. The process of claim 16, further comprising:

at least one co-substrate selected from the group consisting of a $C_6$ to $C_{100}$ monocarboxylic acid or anhydride thereof, a $C_{12}$ to $C_{100}$ polycarboxylic acid or anhydride thereof, a hydrocarbyl-substituted phenol, a hydrocarbyl-substituted sulphonic acid, a hydrocarbyl-substituted salicylic acid, and a hydrocarbyl-substituted naphthenic acid that is present during the reaction.

18. The process of claim 16 wherein the orthoboric acid or a reactive equivalent thereof is added after the addition of carbon dioxide.

* * * * *